US011446891B2

(12) United States Patent
Fredander et al.

(10) Patent No.: US 11,446,891 B2
(45) Date of Patent: Sep. 20, 2022

(54) TOOL HEAD POSITIONING MECHANISM FOR A CONVERTING MACHINE, AND METHOD FOR POSITIONING A PLURALITY OF TOOL HEADS IN A CONVERTING MACHINE

(71) Applicant: PACKSIZE LLC, Salt Lake City, UT (US)

(72) Inventors: Bo Fredander, Bro (SE); Johan Blomberg, Uppsala (SE)

(73) Assignee: PACKSIZE LLC, Salt Lake City, UT (US)

( * ) Notice: Subject to any disclaimer, the term of this patent is extended or adjusted under 35 U.S.C. 154(b) by 46 days.

(21) Appl. No.: 16/619,818

(22) PCT Filed: May 11, 2018

(86) PCT No.: PCT/US2018/032311
§ 371 (c)(1),
(2) Date: Dec. 5, 2019

(87) PCT Pub. No.: WO2018/226363
PCT Pub. Date: Dec. 13, 2018

(65) Prior Publication Data

US 2020/0101686 A1 Apr. 2, 2020

(30) Foreign Application Priority Data

Jun. 8, 2017 (SE) ..... 1750727-8

(51) Int. Cl.
*B31B 50/00* (2017.01)
*B31B 50/14* (2017.01)
*B31B 50/25* (2017.01)

(52) U.S. Cl.
CPC ..... *B31B 50/006* (2017.08); *B31B 50/005* (2017.08); *B31B 50/144* (2017.08); *B31B 50/254* (2017.08)

(58) Field of Classification Search
CPC ..... B26D 11/00; B26D 1/225; B26D 7/2635; B31F 1/10; B31B 50/005; B31B 50/006;
(Continued)

(56) References Cited

U.S. PATENT DOCUMENTS 1,809,853 A 6/1931 Knowlton
2,077,428 A 4/1937 Mabon
(Continued)

FOREIGN PATENT DOCUMENTS

CN 2164350 Y 5/1994
CN 1191833 A 9/1998
(Continued)

OTHER PUBLICATIONS

International Search Report and Written Opinion for application No. PCT/US2012/070719 dated Feb. 25, 2013.
(Continued)

*Primary Examiner* — Andrew M Tecco
*Assistant Examiner* — Nicholas E Igbokwe
(74) *Attorney, Agent, or Firm* — Workman Nydegger

(57) ABSTRACT

The present invention relates to a method for positioning a plurality of tool heads in a converting machine for converting sheet material into box templates, comprising: providing a plurality of tool heads located at a first set of individual positions within a converting area, moving the plurality of tool heads within the converting area in a first movement by means of a transport mechanism that is arranged to be coupled individually to each tool head, moving at least one of the plurality of tool heads in relation to the transport mechanism in a second movement, wherein the plurality of
(Continued)

Figure 1:
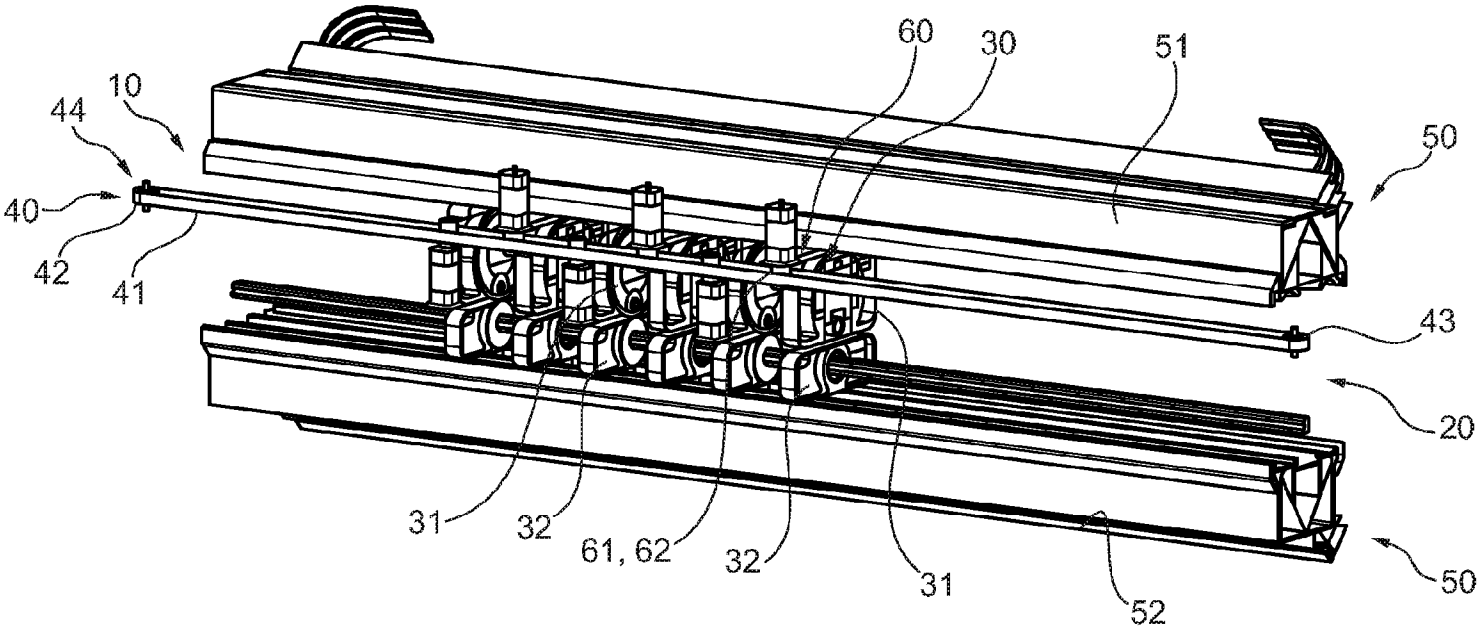

tool heads are moved to a second set of individual positions by the first and second movement, and wherein the second movement takes place during the first movement. The invention also relates to a tool heads positioning device.

20 Claims, 5 Drawing Sheets

(58) Field of Classification Search
CPC ..... B31B 50/10; B31B 50/18; B31B 50/144; B31B 50/25; B31B 50/254
See application file for complete search history.

(56) References Cited

U.S. PATENT DOCUMENTS 2,083,351 A 6/1937 Sidebotham
2,181,117 A 11/1939 Brenn
2,256,082 A 9/1941 Feurt
2,353,419 A 7/1944 Smithson
2,449,663 A 9/1948 Nicholas
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe et al.
2,904,789 A 9/1959 Radin et al.
3,096,692 A 7/1963 Crathern et al.
3,105,419 A 10/1963 La Bombard
3,108,515 A 10/1963 Stohlquist
3,153,991 A 10/1964 Goodrich
3,285,145 A 11/1966 Lieberman
3,303,759 A 2/1967 Burke
3,308,723 A 3/1967 Bergh, Jr.
3,332,207 A 7/1967 Midnight
3,406,611 A 10/1968 Benjamin et al.
3,418,893 A 12/1968 Stohlquist et al.
3,469,508 A 9/1969 Klapp
3,511,496 A 5/1970 Zoglmann
3,543,469 A 12/1970 Ullman
3,555,776 A 1/1971 Nigrelli et al.
3,566,755 A 3/1971 Smith et al.
3,611,884 A 10/1971 Hottendorf
3,618,479 A 11/1971 Shields
3,628,408 A 12/1971 Rod
3,646,418 A 2/1972 Sterns et al.
3,743,154 A 7/1973 Brewitz
3,756,586 A 9/1973 Craft
3,776,109 A 12/1973 Clark et al.
3,803,798 A 4/1974 Clancy
3,804,514 A 4/1974 Jasinski
3,807,726 A 4/1974 Hope et al.
3,866,391 A 2/1975 Puskarz et al.
3,882,764 A 5/1975 Johnson
3,886,833 A 6/1975 Gunn et al.
3,891,203 A 6/1975 Schiff
3,912,389 A 10/1975 Miyamoto
3,913,464 A 10/1975 Flaum
3,949,654 A 4/1976 Stehlin
3,986,319 A 10/1976 Puskarz et al.
4,033,217 A 7/1977 Flaum et al.
4,044,658 A 8/1977 Mitchard
4,052,048 A 10/1977 Shirasaka
4,053,152 A 10/1977 Matsumoto
4,056,025 A 11/1977 Rubel
4,094,451 A 6/1978 Wescoat
4,121,506 A 10/1978 Van Grouw
4,123,966 A 11/1978 Buschor
4,164,171 A 8/1979 Gorshe et al.
4,173,106 A 11/1979 Leasure et al.
4,184,770 A 1/1980 Pinior
4,191,467 A 3/1980 Schieck
4,221,373 A 9/1980 Muller Hans
4,222,557 A 9/1980 Wu
4,224,847 A 9/1980 Tokuno
4,252,233 A 2/1981 Joice
4,261,239 A 4/1981 Toboshi et al.
4,264,200 A 4/1981 Tickner et al.
4,295,841 A 10/1981 Ward, Jr.
4,320,960 A 3/1982 Ward et al.
4,342,562 A 8/1982 Froeidh et al.
4,351,461 A 9/1982 Carlsson
4,368,052 A 1/1983 Bitsky et al.
4,373,412 A 2/1983 Gerber et al.
4,375,970 A 3/1983 Murphy et al.
4,401,250 A 8/1983 Carlsson
4,449,349 A 5/1984 Roth
4,487,596 A 12/1984 Livens et al.
4,563,169 A 1/1986 Virta et al.
4,578,054 A 3/1986 Herrin
D286,044 S 10/1986 Kando
4,638,696 A 1/1987 Urwyler
4,674,734 A 6/1987 Ibuchi
4,684,360 A 8/1987 Tokuno et al.
4,695,006 A 9/1987 Pool
4,714,946 A 12/1987 Bajgert et al.
4,743,131 A 5/1988 Atwell
4,749,295 A 6/1988 Bankier et al.
4,773,781 A 9/1988 Bankier
4,838,468 A 6/1989 Lesse
4,844,316 A 7/1989 Keeny
4,847,632 A 7/1989 Norris
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
4,994,008 A 2/1991 Haake et al.
5,005,816 A 4/1991 Stemmler et al.
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer et al.
5,090,281 A 2/1992 Paulson et al.
5,094,660 A 3/1992 Okuzawa
5,106,359 A 4/1992 Lott
5,111,252 A 5/1992 Hamada et al.
5,116,034 A 5/1992 Trask et al.
5,118,093 A 6/1992 Makiura et al.
5,120,279 A 6/1992 Rabe
5,120,297 A 6/1992 Adami
5,123,890 A 6/1992 Green, Jr.
5,123,894 A 6/1992 Bergeman et al.
5,137,172 A 8/1992 Wagner et al.
5,137,174 A 8/1992 Bell
5,148,654 A 9/1992 Kisters
5,154,041 A 10/1992 Schneider
5,157,903 A 10/1992 Nakashima et al.
5,197,366 A 3/1993 Paulson et al.
5,240,243 A 8/1993 Gompertz et al.
5,241,353 A 8/1993 Maeshima et al.
5,259,255 A * 11/1993 Urban ..... B26D 7/2635 83/508.3
5,263,785 A 11/1993 Negoro et al.
D344,751 S 3/1994 Keong
5,305,993 A 4/1994 Staeb
5,321,464 A 6/1994 Jessen et al.
5,335,777 A 8/1994 Murphy et al.
5,358,345 A 10/1994 Damitio
5,369,939 A 12/1994 Moen et al.
5,375,390 A 12/1994 Frigo et al.
5,397,423 A 3/1995 Bantz et al.
5,411,252 A 5/1995 Lowell
5,584,633 A 12/1996 Scharer
5,586,758 A 12/1996 Kimura et al.
5,624,369 A 4/1997 Bidlack et al.
5,667,468 A 9/1997 Bandura
5,671,593 A 9/1997 Ginestra et al.
5,716,313 A 2/1998 Sigrist et al.
5,727,725 A 3/1998 Paskvich
5,767,975 A 6/1998 Ahlen

(56) References Cited

U.S. PATENT DOCUMENTS 5,836,498 A 11/1998 Turek
5,887,867 A 3/1999 Takahashi et al.
5,902,223 A 5/1999 Simmons
5,927,702 A 7/1999 Ishii et al.
5,941,451 A 8/1999 Dexter
5,964,686 A * 10/1999 Bidlack ..... B26F 1/00 493/63
6,000,525 A 12/1999 Frulio
6,071,223 A 6/2000 Reider et al.
6,113,525 A 9/2000 Waechter
6,135,438 A 10/2000 Newman et al.
6,164,045 A 12/2000 Focke et al.
6,189,933 B1 2/2001 Felderman
6,245,004 B1 * 6/2001 Waters ..... B26F 1/3813 493/473
6,321,650 B1 11/2001 Ogawa et al.
6,397,557 B1 6/2002 Bassissi et al.
6,428,000 B1 8/2002 Hara et al.
6,471,154 B1 10/2002 Toth
6,553,207 B2 4/2003 Tsusaka et al.
6,568,865 B1 5/2003 Fujioka et al.
6,673,001 B2 1/2004 Toth
6,690,476 B1 2/2004 Hren
6,709,177 B1 3/2004 Sugimura
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,968,859 B1 11/2005 Nagano et al.
7,060,016 B2 6/2006 Cipolli
7,100,811 B2 9/2006 Pettersson et al.
7,115,086 B1 10/2006 Campbell, Jr.
7,121,543 B2 10/2006 Fujioka
7,201,089 B2 4/2007 Richter
7,237,969 B2 7/2007 Bartman
7,537,557 B2 5/2009 Holler
7,637,857 B2 12/2009 Coullery et al.
7,641,190 B2 1/2010 Hara et al.
7,647,752 B2 1/2010 Magnell
7,648,451 B2 1/2010 Calugi
7,648,596 B2 1/2010 Sharpe et al.
7,690,099 B2 4/2010 Bapst et al.
7,735,299 B2 6/2010 Cash, III
7,739,856 B2 6/2010 Cash, III
7,997,578 B2 8/2011 Saito et al.
D703,246 S 4/2014 Pettersson et al.
8,999,108 B2 4/2015 Nagao et al.
9,069,151 B2 6/2015 Conner
9,120,284 B2 9/2015 Capoia
9,199,794 B2 12/2015 Nadachi et al.
9,329,565 B2 5/2016 Osaki
9,352,526 B2 5/2016 Pettersson
9,434,496 B2 9/2016 Sytema
9,924,502 B2 3/2018 Choi
9,969,142 B2 5/2018 Pettersson et al.
10,093,438 B2 10/2018 Pettersson
10,155,352 B2 12/2018 Sytema et al.
10,286,621 B2 5/2019 Toro
10,583,943 B2 3/2020 Feijen et al.
10,836,516 B2 11/2020 Pettersson
10,836,517 B2 11/2020 Ponti
2002/0017754 A1 2/2002 Kang
2002/0066683 A1 6/2002 Sanders
2002/0091050 A1 7/2002 Bacciottini et al.
2002/0108476 A1 8/2002 Guidetti
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski
2004/0060264 A1 4/2004 Miller
2004/0082453 A1 * 4/2004 Pettersson ..... G05B 19/19 493/180
2004/0092374 A1 5/2004 Cheng
2004/0144555 A1 7/2004 Buekers et al.
2004/0173068 A1 9/2004 Adachi
2004/0198577 A1 10/2004 Blumle
2004/0214703 A1 10/2004 Berens et al.
2004/0261365 A1 12/2004 White
2005/0079965 A1 4/2005 Moshier et al.
2005/0103923 A1 5/2005 Pettersson et al.
2005/0215409 A1 9/2005 Abramson et al.
2005/0280202 A1 12/2005 Vila et al.
2006/0178248 A1 8/2006 Coullery et al.
2006/0180438 A1 8/2006 Mosli et al.
2006/0180991 A1 8/2006 Nakahata et al.
2006/0181008 A1 8/2006 Van et al.
2007/0079575 A1 4/2007 Monti
2007/0227927 A1 10/2007 Coltri-Johnson
2007/0228119 A1 10/2007 Barner
2007/0287623 A1 12/2007 Carlson et al.
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0011924 A1 1/2010 Bernreuter
2010/0012628 A1 1/2010 Koshy et al.
2010/0041534 A1 2/2010 Harding et al.
2010/0111584 A1 5/2010 Shiohara et al.
2010/0206582 A1 8/2010 Meyyappan et al.
2010/0210439 A1 8/2010 Goto
2011/0026999 A1 2/2011 Kohira
2011/0053746 A1 3/2011 Desertot et al.
2011/0092351 A1 4/2011 Hatano et al.
2011/0099782 A1 5/2011 Schonberger et al.
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0240707 A1 10/2011 Beguin et al.
2011/0269995 A1 11/2011 Olbert et al.
2011/0283855 A1 11/2011 Kwarta et al.
2011/0319242 A1 12/2011 Pettersson
2012/0021884 A1 1/2012 Musha
2012/0037680 A1 2/2012 Ito
2012/0106963 A1 5/2012 Huang et al.
2012/0122640 A1 5/2012 Pazdernik et al.
2012/0129670 A1 5/2012 Pettersson et al.
2012/0139670 A1 6/2012 Yamagata et al.
2012/0142512 A1 6/2012 Keller
2012/0242512 A1 9/2012 Horstemeyer
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0130877 A1 5/2013 Su
2013/0146355 A1 6/2013 Strasser et al.
2013/0210597 A1 8/2013 Pettersson
2013/0294735 A1 11/2013 Burris et al.
2013/0333538 A1 12/2013 Long et al.
2014/0078635 A1 3/2014 Conner et al.
2014/0091511 A1 4/2014 Martin
2014/0101929 A1 4/2014 Kim et al.
2014/0140671 A1 5/2014 Islam
2014/0315701 A1 * 10/2014 Pettersson ..... B31B 50/20 493/56
2014/0316336 A1 10/2014 Hawasheen
2014/0318336 A1 10/2014 De Marco et al.
2014/0336026 A1 11/2014 Pettersson
2014/0357463 A1 12/2014 Kojima
2015/0018189 A1 * 1/2015 Pettersson ..... B26D 7/2635 493/395
2015/0019387 A1 1/2015 Pettersson et al.
2015/0053349 A1 2/2015 Mori et al.
2015/0055926 A1 2/2015 Strasser et al.
2015/0103923 A1 4/2015 Ramasubramonian et al.

(56) References Cited

U.S. PATENT DOCUMENTS

| | | | |
|---|---|---|---|
| 2015/0148210 | A1 | 5/2015 | Sibthorpe |
| 2015/0155697 | A1 | 6/2015 | Loveless et al. |
| 2015/0224731 | A1 | 8/2015 | Ponti |
| 2015/0273897 | A1 | 10/2015 | Kato et al. |
| 2015/0355429 | A1 | 12/2015 | Villegas et al. |
| 2015/0360433 | A1 | 12/2015 | Feijen et al. |
| 2015/0360801 | A1 | 12/2015 | Sytema |
| 2016/0001441 | A1 | 1/2016 | Osterhout et al. |
| 2016/0049782 | A1 | 2/2016 | Strasser et al. |
| 2016/0122044 | A1 | 5/2016 | Evers et al. |
| 2016/0184142 | A1 | 6/2016 | Vanvalkenburgh et al. |
| 2016/0185065 | A1 | 6/2016 | Sytema et al. |
| 2016/0185475 | A1 | 6/2016 | Pettersson |
| 2016/0241468 | A1 | 8/2016 | Sabella et al. |
| 2016/0340067 | A1 | 11/2016 | Winkler et al. |
| 2017/0190134 | A1 | 7/2017 | Van et al. |
| 2017/0355166 | A1 | 12/2017 | Jonker |
| 2017/0361560 | A1 | 12/2017 | Osterhout |
| 2018/0178476 | A1 | 6/2018 | Pettersson et al. |
| 2018/0201465 | A1 | 7/2018 | Osterhout |
| 2018/0265228 | A1 | 9/2018 | Hagestedt et al. |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson |
| 2019/0389611 | A1 | 12/2019 | Pettersson |
| 2020/0031506 | A1 | 1/2020 | Ponti |
| 2020/0407087 | A1 | 12/2020 | Pettersson |
| 2021/0001583 | A1 | 1/2021 | Osterhout |
| 2021/0039347 | A1 | 2/2021 | Pettersson et al. |
| 2021/0261281 | A1 | 8/2021 | Engleman et al. |
| 2021/0370633 | A1 | 12/2021 | Provoost et al. |
| 2021/0371229 | A1 | 12/2021 | Osterhout |
| 2022/0153462 | A1 | 5/2022 | Provoost et al. |

FOREIGN PATENT DOCUMENTS

| | | | |
|---|---|---|---|
| CN | 1366487 | A | 8/2002 |
| CN | 1449966 | A | 10/2003 |
| CN | 1876361 | A | 12/2006 |
| CN | 2925862 | Y | 7/2007 |
| CN | 201941185 | U | 8/2011 |
| CN | 201990294 | U | 9/2011 |
| CN | 102371705 | A | 3/2012 |
| CN | 102574654 | A | 7/2012 |
| CN | 202412794 | U | 9/2012 |
| CN | 102753442 | A | 10/2012 |
| CN | 102791581 | A | 11/2012 |
| CN | 103534069 | A | 1/2014 |
| CN | 104044166 | A | 9/2014 |
| CN | 104169073 | A | 11/2014 |
| CN | 104185538 | A | 12/2014 |
| CN | 102941592 | | 4/2015 |
| CN | 104812560 | A | 7/2015 |
| CN | 104890208 | A | 9/2015 |
| CN | 104985868 | A | 10/2015 |
| CN | 204773785 | U | 11/2015 |
| CN | 106079570 | A | 11/2016 |
| CN | 107614253 | A | 1/2018 |
| DE | 1082227 | B | 5/1960 |
| DE | 1212854 | B | 3/1966 |
| DE | 2700004 | A1 | 7/1978 |
| DE | 2819000 | A1 | 11/1978 |
| DE | 3343523 | A1 | 6/1985 |
| DE | 3825506 | A1 | 2/1990 |
| DE | 19541061 | C1 | 11/1996 |
| DE | 10355544 | A1 | 6/2005 |
| DE | 102005063193 | A1 | 7/2007 |
| DE | 102008035278 | A1 | 2/2010 |
| EP | 0030366 | A1 | 6/1981 |
| EP | 0234228 | A2 | 9/1987 |
| EP | 0359005 | A1 | 3/1990 |
| EP | 0650827 | A2 | 5/1995 |
| EP | 0889779 | A2 | 1/1999 |
| EP | 0903219 | A2 | 3/1999 |
| EP | 1065162 | A2 | 1/2001 |
| EP | 1223107 | A1 | 7/2002 |
| EP | 1373112 | A1 | 1/2004 |
| EP | 1428759 | A2 | 6/2004 |
| EP | 1997736 | A2 | 12/2008 |
| EP | 1497049 | B1 | 3/2010 |
| EP | 2228206 | A1 | 9/2010 |
| EP | 2377764 | A1 | 10/2011 |
| EP | 3231594 | A1 | 10/2017 |
| FR | 0428967 | A | 9/1911 |
| FR | 1020458 | A | 2/1953 |
| FR | 1592372 | A | 5/1970 |
| FR | 2280484 | A1 | 2/1976 |
| FR | 2411700 | A1 | 7/1979 |
| FR | 2626642 | A1 | 8/1989 |
| FR | 2721301 | A1 | 12/1995 |
| FR | 2770445 | A1 | 5/1999 |
| FR | 2808722 | A1 | 11/2001 |
| FR | 2814393 | A1 | 3/2002 |
| FR | 2976561 | A1 | 12/2012 |
| GB | 0166622 | | 7/1921 |
| GB | 0983946 | A | 2/1965 |
| GB | 1362060 | A | 7/1974 |
| GB | 1546789 | A | 5/1979 |
| JP | 49-099239 | A | 9/1974 |
| JP | 50-078616 | A | 6/1975 |
| JP | 51-027619 | A | 3/1976 |
| JP | 55-057984 | A | 4/1980 |
| JP | 56-089937 | A | 7/1981 |
| JP | 59-176836 | A | 10/1984 |
| JP | 59-198243 | A | 11/1984 |
| JP | 61-118720 | A | 6/1986 |
| JP | 62-172032 | | 10/1987 |
| JP | 01-133164 | A | 5/1989 |
| JP | 03-070927 | A | 3/1991 |
| JP | 3089399 | | 9/1991 |
| JP | 06-123606 | A | 5/1994 |
| JP | 07-156305 | A | 6/1995 |
| JP | 08-238690 | A | 9/1996 |
| JP | 08-333036 | A | 12/1996 |
| JP | 09-506847 | A | 7/1997 |
| JP | 11-320492 | A | 11/1999 |
| JP | 2000-323324 | A | 11/2000 |
| JP | 2003-079446 | A | 3/2003 |
| JP | 2003-112849 | A | 4/2003 |
| JP | 2003-194516 | A | 7/2003 |
| JP | 2004-330351 | A | 11/2004 |
| JP | 2005-067019 | A | 3/2005 |
| JP | 2005-219798 | A | 8/2005 |
| JP | 2006-289914 | A | 10/2006 |
| JP | 2007-331810 | A | 12/2007 |
| JP | 2008-254789 | A | 10/2008 |
| JP | 2009-023074 | | 2/2009 |
| JP | 2009-132049 | A | 6/2009 |
| JP | 2010-012628 | A | 1/2010 |
| JP | 2011-053284 | A | 3/2011 |
| JP | 2011-520674 | A | 7/2011 |
| JP | 2011-230385 | A | 11/2011 |
| JP | 2015-502273 | A | 1/2015 |
| JP | 2016-074133 | A | 5/2016 |
| RU | 2015030 | C1 | 6/1994 |
| RU | 2004136918 | A | 5/2006 |
| RU | 2334668 | C2 | 9/2008 |
| RU | 2345893 | C2 | 2/2009 |
| RU | 2398674 | C1 | 9/2010 |
| RU | 2014123534 | A | 12/2015 |
| RU | 2014123562 | A | 12/2015 |
| SE | 0450829 | B | 8/1987 |
| SE | 450829 | B | 8/1987 |
| SE | 515630 | C2 | 9/2001 |
| SU | 40025 | A1 | 12/1934 |
| SU | 992220 | A1 | 1/1983 |
| SU | 1054863 | A1 | 11/1983 |
| SU | 1121156 | A1 | 10/1984 |
| SU | 1676825 | A1 | 9/1991 |
| SU | 1718783 | A1 | 3/1992 |
| SU | 1756211 | A1 | 8/1992 |
| TW | 394741 | B | 6/2000 |

(56) References Cited

FOREIGN PATENT DOCUMENTS

| | | | |
|---|---|---|---|
| WO | 96/10518 | A1 | 4/1996 |
| WO | 96/14773 | A1 | 5/1996 |
| WO | 97/31773 | A2 | 9/1997 |
| WO | 99/17923 | A1 | 4/1999 |
| WO | 00/21713 | A1 | 4/2000 |
| WO | 01/04017 | A1 | 1/2001 |
| WO | 01/85408 | A2 | 11/2001 |
| WO | 02/79062 | A1 | 10/2002 |
| WO | 03/89163 | A2 | 10/2003 |
| WO | 03/97340 | | 11/2003 |
| WO | 2009/093936 | A1 | 7/2009 |
| WO | 2010/091043 | A1 | 8/2010 |
| WO | 2011007237 | A1 | 1/2011 |
| WO | 2011/100078 | A2 | 8/2011 |
| WO | 2011/135433 | A1 | 11/2011 |
| WO | 2012/003167 | A1 | 1/2012 |
| WO | 2013/071080 | A1 | 5/2013 |
| WO | 2013071073 | A1 | 5/2013 |
| WO | 2013/106180 | A1 | 7/2013 |
| WO | 2013/114057 | A2 | 8/2013 |
| WO | 2014/048934 | A1 | 4/2014 |
| WO | 2014/117816 | | 8/2014 |
| WO | 2014/117817 | A1 | 8/2014 |
| WO | 2015/173745 | A1 | 11/2015 |
| WO | 2016/176271 | A1 | 11/2016 |
| WO | 2017/203399 | A1 | 11/2017 |
| WO | 2017/203401 | A1 | 11/2017 |
| WO | 2017/218296 | A1 | 12/2017 |
| WO | 2017/218297 | A1 | 12/2017 |

OTHER PUBLICATIONS

International Search Report and Written Opinion for corresponding PCT Application No. PCT/IB2015/054179, dated Aug. 28, 2015, 13 pages.
Office Action received for U.S. Appl. No. 15/901,089, dated Apr. 13, 2020.
U. S. Patent Application mailed on Dec. 14, 2018, filed by Pettersson et al., U.S. Appl. No. 16/310,406.
U. S. Patent Application mailed on Jan. 16, 2018 filed by Osterhout, U.S. Appl. No. 15/872,770.
U.S. Provisional Application mailed on Jan. 18, 2017, filed by Osterhout, U.S. Appl. No. 62/447,714.
U.S. Appl. No. 16/435,252, filed Jun. 7, 2019.
Non-Final Office Action received for U.S. Appl. No. 16/375,579, dated Feb. 18, 2021, 12 pages.
International Search Report and Written Opinion issued in PCT/US2018/032311 dated Sep. 20, 2018.
Non-Final Office Action received for U.S. Appl. No. 16/375,588, dated Jul. 2, 2021, 15 pages.
Notice of Allowance received for U.S. Appl. No. 15/901,089, dated Jan. 31, 2022, 9 pages.
Final Office Action received for U.S. Appl. No. 14/370,729, dated Jul. 12, 2017.
Final Office Action received for U.S. Appl. No. 14/357,190 dated Aug. 1, 2017.
International Search Report and Written Opininon for application No. PCT/US2017/036606 dated Oct. 24, 2017.
International Search Report and Written Opinion for application No. PCT/US2010/022983 dated Apr. 13, 2010.
International Search Report and Written Opinion for application No. PCT/US2017/036603 dated Oct. 27, 2017.
International Search Report and Written Opinion for PCT/US18/14275 dated Apr. 4, 2018.
International Search Report and Written Opinion for PCT/US19/62696 dated Feb. 4, 2020.
International Search Report and Written Opinion for PCT/US2015/67375 dated Mar. 11, 2016.
International Search Report and Written Opinion for PCT/US2019/038142 dated Aug. 2, 2019.
International Search Report and Written Opinion for PCT/US2019/049102 dated Dec. 2, 2019.
International Search Report and Written Opinion issued in PCT/US2018/020928 dated Jun. 7, 2018.
International Search Report and Written Opinion PCT/IB2019/052793 dated Nov. 11, 2019.
International Search Report and Written Opinion PCT/IB2019/052794 dated Jun. 19, 2019.
International Search Report and Written Opinion, PCT/US2012/064403, US Search Authority, Completed Mar. 26, 2013, dated Apr. 8, 2013.
International Search Report and Written Opinion, PCT/US2012/064414, US Search Authority, Completed Jan. 4, 2013, dated Jan. 25, 2013.
International Search Report for PCT/US2011/042096 dated Oct. 28, 2011.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 14/370,729, dated Dec. 19, 2017.
Office Action received for U.S. Appl. No. 14/370,729, dated Jan. 26, 2017.
Office Action received for U.S. Appl. No. 15/616,688 dated Mar. 19, 2020.
Office Action received for U.S. Appl. No. 15/872,770 dated Mar. 27, 2020.
Office Action received for U.S. Appl. No. 16/109,261 dated Apr. 28, 2020.
Office Action received for U.S. Appl. No. 14/970,224, dated May 30, 2018.
U.S. Appl. No. 13/147,787, Apr. 17, 2015, Final Office Action.
U.S. Appl. No. 13/147,787, Feb. 16, 2016, Final Office Action.
U.S. Appl. No. 13/147,787, Aug. 27, 2014, Office Action.
U.S. Appl. No. 13/147,787, Mar. 7, 2017, Final Office Action.
U.S. Appl. No. 13/147,787, Oct. 28, 2016, Office Action.
U.S. Appl. No. 13/147,787, Sep. 30, 2015, Office Action.
U.S. Appl. No. 13/805,602, Dec. 2, 2015, Office Action.
U.S. Appl. No. 14/357,183, Nov. 12, 2015, Final Office Action.
U.S. Appl. No. 29/419,922, Aug. 6, 2013, Office Action.
Non-Final Office Action received for U.S. Appl. No. 17/023,088, dated May 10, 2022, 11 pages.

* cited by examiner

TOOL HEAD POSITIONING MECHANISM FOR A CONVERTING MACHINE, AND METHOD FOR POSITIONING A PLURALITY OF TOOL HEADS IN A CONVERTING MACHINE

CROSS-REFERENCE TO RELATED APPLICATIONS

This application claims priority to PCT Application No. PCT/US2018/032311, filed May 11, 2018, entitled "TOOL HEAD POSITIONING MECHANISM FOR A CONVERTING MACHINE, AND METHOD FOR POSITIONING A PLURALITY OF TOOL HEADS IN A CONVERTING MACHINE", which claims the benefit of and priority to Sweden Application No. 1750727-8, filed Jun. 8, 2017. All the aforementioned applications are incorporated by reference herein in their entirety.

TECHNICAL FIELD

The present invention relates to a tool head positioning mechanism and a method for positioning a plurality of tool heads in a converting machine, said converting machine being able to convert fanfold material into box templates.

BACKGROUND

Machines and processing equipment for converting fanfold materials into box templates are frequently used in many technical fields, especially within shipping and packaging industries. Fanfold material, as understood herein, comprises paperboard, corrugated board, cardboard and similar materials that are suitable for packaging purposes. Generally, the fanfold material is processed by a converting machine having a plurality of tool heads arranged in a converting area to act on the fanfold material and produce box templates by cutting and/or creasing the fanfold material as it passes through the machine.

As is well known within the art, it is especially advantageous to adapt the size and shape of the box templates to the products that are to be stored and transported in them, and it is therefore common to position and reposition the tool heads according to dimensions and properties of each new box templates that is to be produced. In some converting machines, two or more different dimensions of fanfold materials are arranged side by side in the converting area and the tool heads are movable from one to the other, in order to have the machine prepared to deliver box templates of different sizes and shapes without requiring removal of one width of fanfold material and supply of another. The tool heads then operate in one part of the converting area and are moved to another part when box templates of different dimensions are to be produced.

Moving and positioning the tool heads within the converting area is generally performed either by moving one tool head at a time, or by moving all tool heads together and then adjusting them individually to their new positions before operation on the fanfold material can be resumed. The positioning must be achieved quickly and with high precision to minimize the time that the converting machine stands idle and to enable operation at a desired level of quality. Some positioning systems are available today but none of them are able to provide high quality and stable operation of the tool heads while also performing the repositioning and moving quickly.

There is therefore a need for an improved method and device for the positioning of tool heads in a converting machine.

SUMMARY OF THE INVENTION

The object of the present invention is to eliminate or at least to minimize the problems mentioned above. This is achieved through a tool head positioning device for a converting machine according to the appended independent claim. Thanks to the invention, the positioning can be performed more quickly and with higher precision than in previously known devices. This is achieved thanks to the cooperation of a conveyor arrangement of a joint transport mechanism that moves all tool heads simultaneously and a plurality of individual transport mechanisms that each move one tool head in relation to the conveyor arrangement. Thanks to the combination of a first movement by the conveyor arrangement and a second movement by the individual transport mechanisms, the positioning of the tool heads can be performed quicker and more efficiently than in the known devices for this purpose.

According to one aspect of the invention, the conveyor arrangement comprises a toothed belt. This is especially advantageous in allowing the tool heads to be easily coupled to the belt and to perform the first movement of the conveyor arrangement in a reliable and efficient way. Alternatively, the conveyor arrangement comprises a rack, a belt, a chain or a wire.

According to another aspect of the invention, the conveyor arrangement is permanently coupled to each of the tool heads. Thereby, the positioning requires very few separate components and eliminate the risk of mistakes during coupling and uncoupling of the tool heads to the conveyor assembly.

According to yet another aspect of the invention, the device comprises an attachment mechanism for attaching each tool head to the conveyor arrangement, said attachment mechanism preferably comprising clamps for clamping each tool head to the conveyor arrangement. Thereby, a higher degree of flexibility is achieved in allowing for some tool heads being coupled to the conveyor assembly and moved, and other tool heads staying in their previous positions.

According to a further aspect of the invention, the individual transport mechanisms each comprise a motor connected to the tool head, wherein said motor acts on the conveyor arrangement to move the tool head along the conveyor arrangement.

Thereby, the gear of the motor can use the conveyor arrangement as counter surface and the second movement can be performed in a sturdy and efficient way. Also, the rotation of the gear along the conveyor arrangement allow for a very precise determination of position of the tool head in relation to the conveyor arrangement. Preferably, every tool head is connected to an individual transport mechanism, but in some embodiments one or more of the tool heads may be moved only in the first movement and maintain their relative positions to the conveyor assembly throughout their operation.

According to yet another aspect of the invention, the converting area comprises at least two converting stations arranged side-by-side, and wherein the first set of individual positions is located at one of the converting stations and the second set of individual positions is located at another. Thereby, the combination of the first and second movement will move and reposition the tool heads from one type of sheet or fanfold material to another, to allow for greater flexibility in manufacturing the box templates.

Many additional benefits and advantages of the invention will become readily apparent to the person skilled in the art in view of the detailed description below.

DRAWINGS

Figure 2:
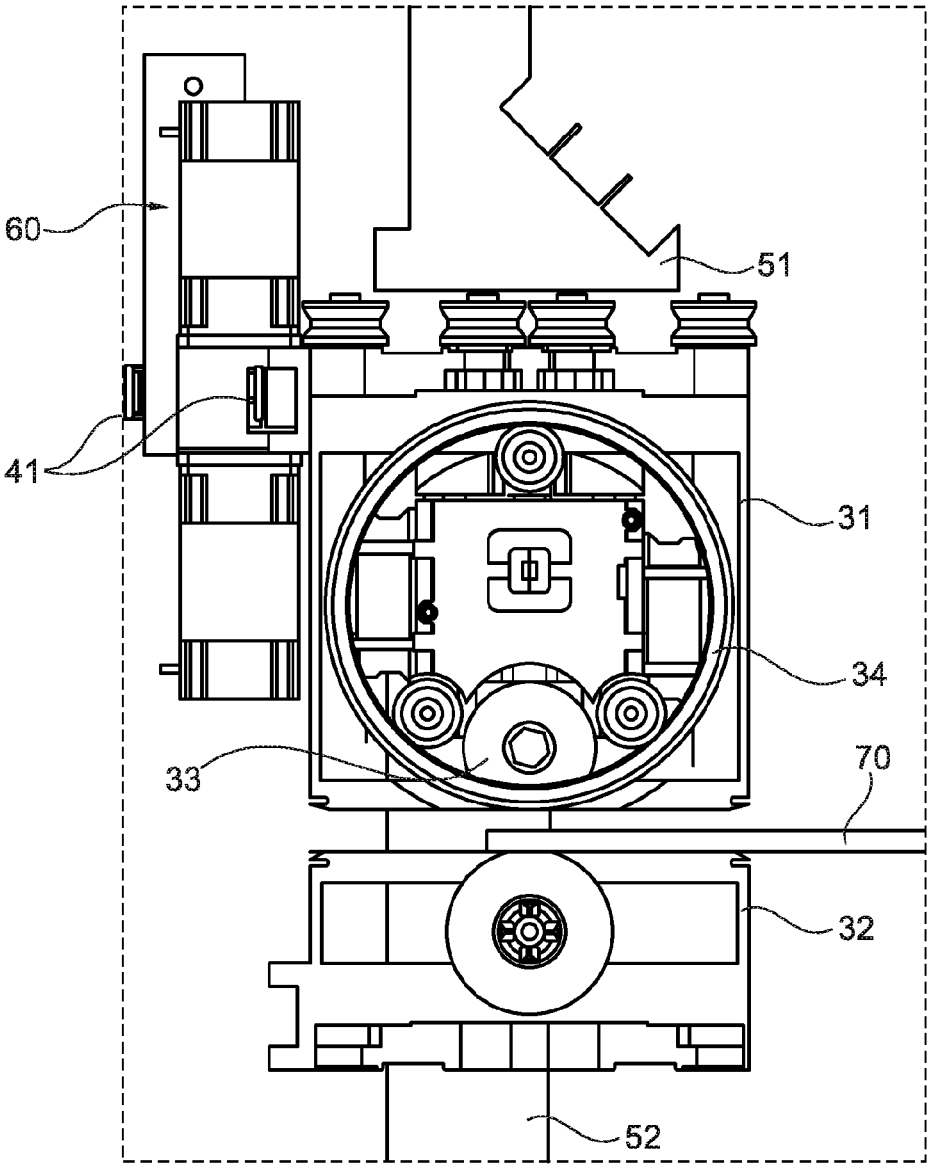
Figure 3:
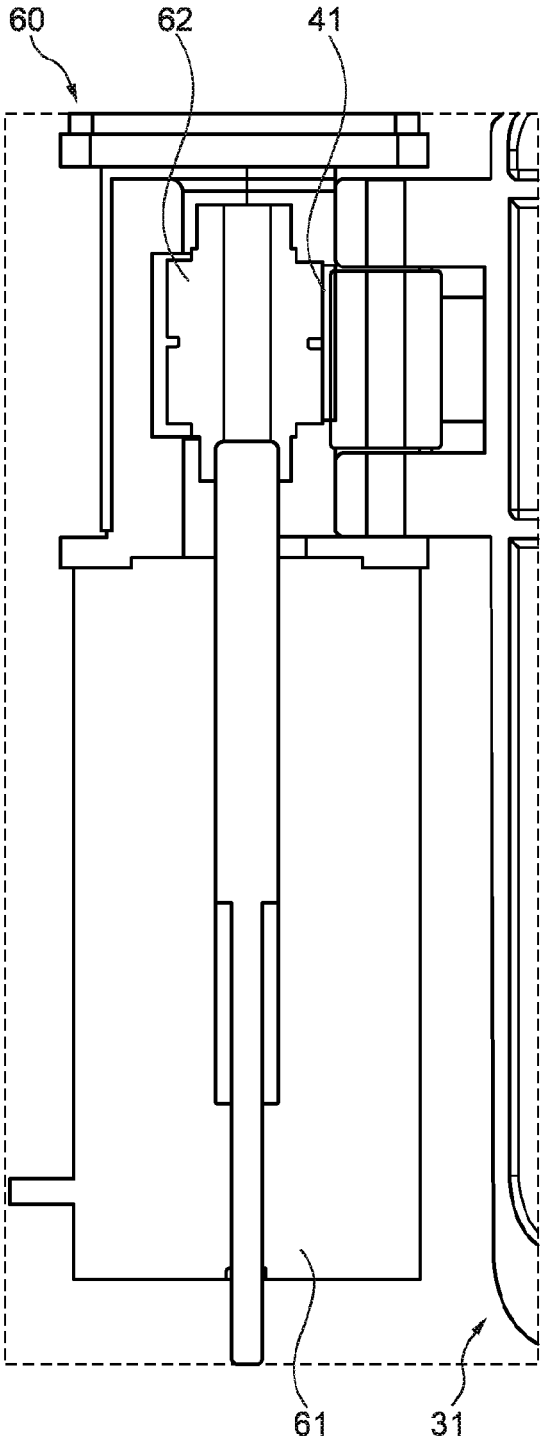
Figure 4:
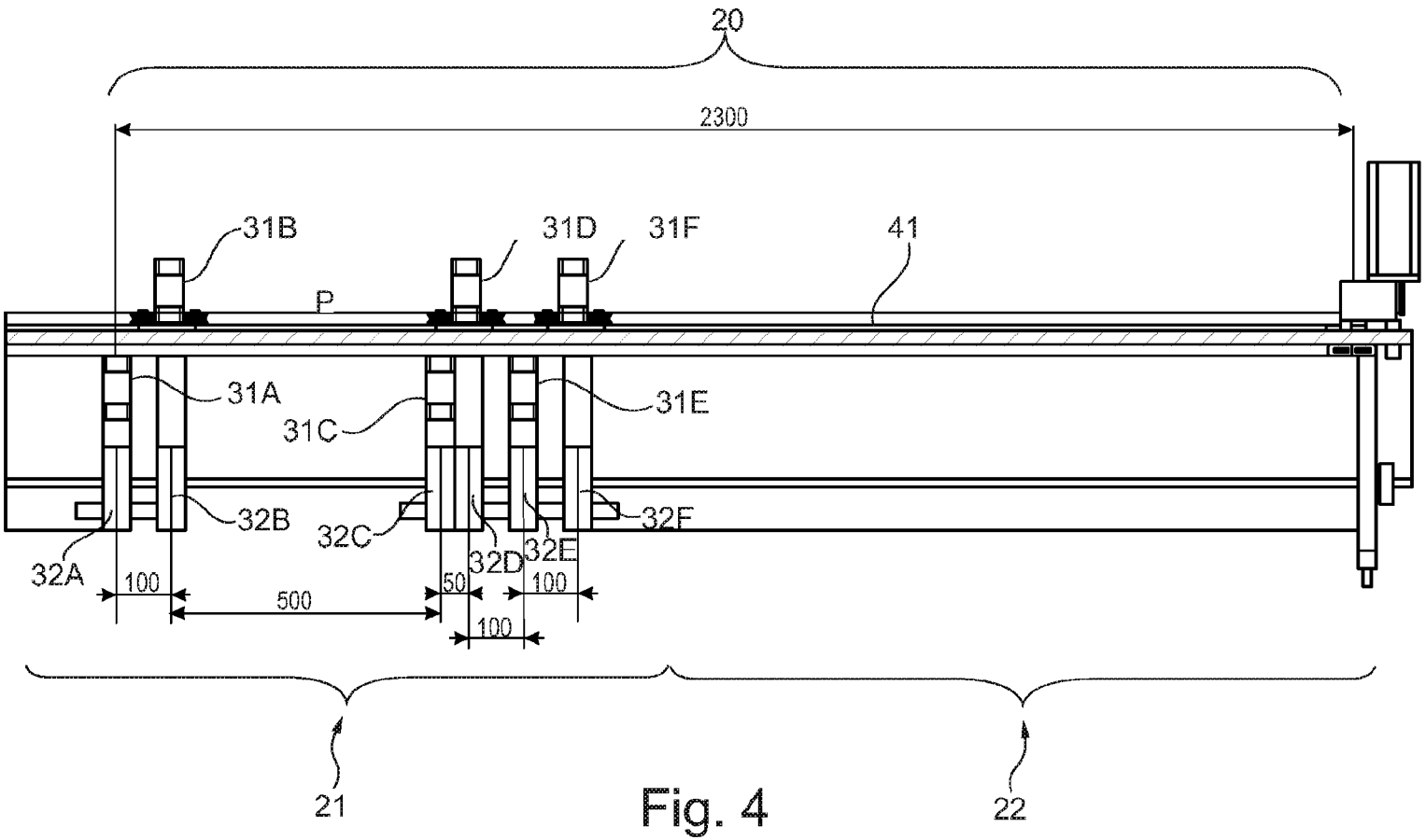
Figure 5:
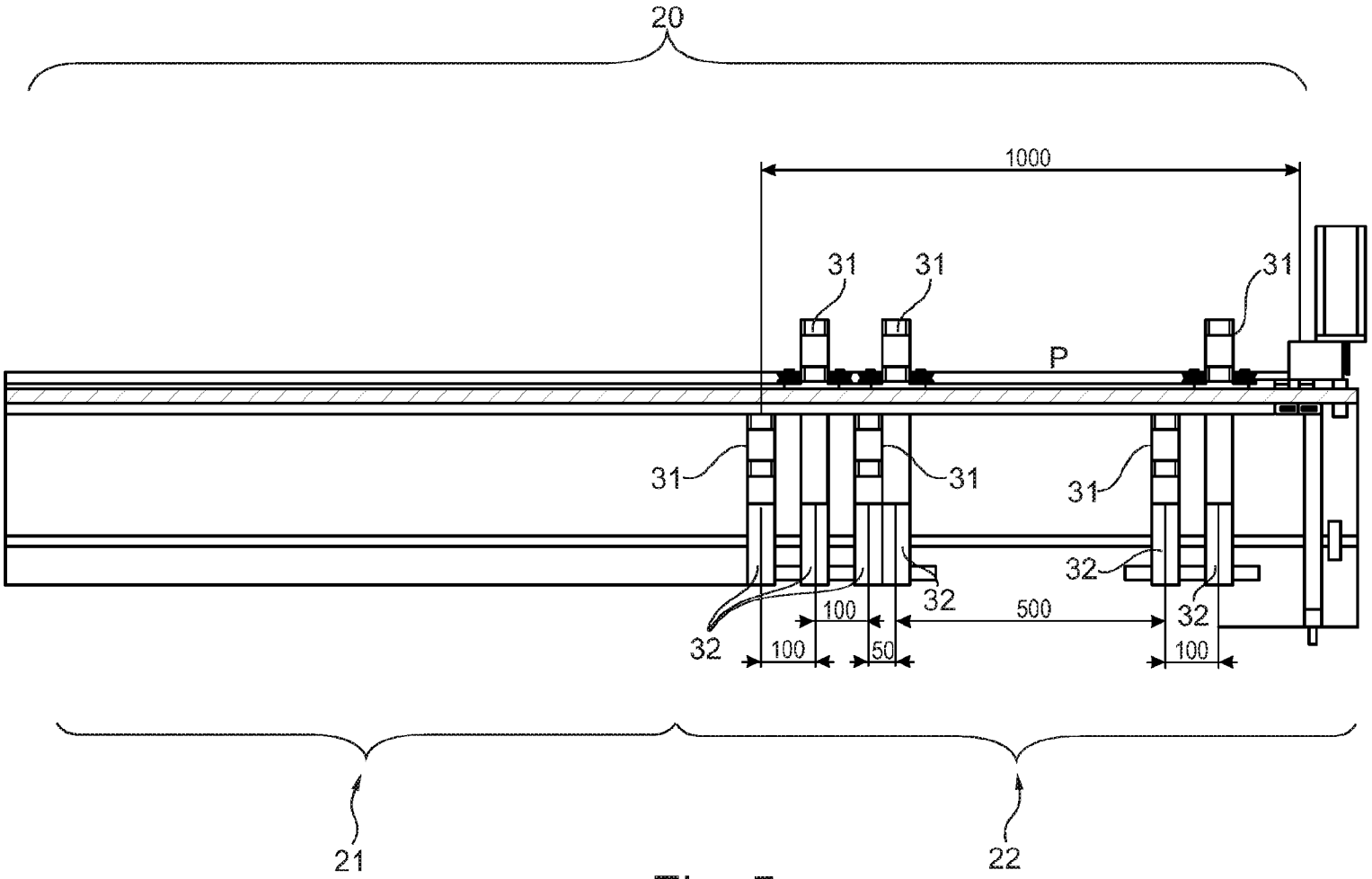

The invention will now be described in more detail with reference to the appended drawings, wherein FIG. 1 discloses a perspective view of a tool head positioning device according to a preferred embodiment of the present invention;

FIG. 2 discloses a planar view from the side of a tool head of the tool head positioning device of FIG. 1;

FIG. 3 discloses a planar view from the side of an individual transport mechanism of the tool head of FIG. 2 and the conveyor arrangement of the tool head positioning device;

FIG. 4 discloses a planar view of the plurality of tool heads of the tool head positioning device at a first set of individual positions; and FIG. 5 discloses a planar view of the plurality of tool heads of FIG. 4 at a second set of individual positions.

DETAILED DESCRIPTION

FIG. 1 discloses a preferred embodiment of a tool head positioning device 10 in a converting area 20 of a converting machine for converting sheet material into packaging templates. The sheet material passes from a bale or similar storage area (not shown) through the machine in a first direction and as it passes through the converting area 20, a plurality of tool heads 30 act on the sheet material by cutting and creasing in predetermined places along the sheet material to produce the packaging or box templates that serve as output from the converting machine. Each tool head 31 is connectable to a conveyor arrangement 41 of a joint transport mechanism 40 and can be moved along the conveyor arrangement 41 within the converting area 20 in a direction transversal to the first direction. Preferably, the sheet material is a fanfold material, and in the following the term fanfold will be used throughout, but it is to be noted that other kinds of sheet material may also be used within the scope of the present invention.

The tool heads 30 are held by an upper section 51 of a holding structure 50 and each tool head 31 may be coupled to a corresponding undercarriage 32 that serves as a counter surface for the cutting and creasing operations. The fanfold material thus passes through the converting area 20 between the tool head 31 and the undercarriage 32. The undercarriages 32 are held by a lower section 52 of the holding structure 50. Alternatively, the counter surface for the tool heads 30 may be a roll or cylinder (not shown).

In this preferred embodiment, the conveyor arrangement 41 is a toothed belt that forms an endless belt and runs between a first and a second conveyor wheel 42, 43. Each tool head 31 is permanently coupled to the belt by an individual transport mechanism comprising a motor 61 with a gear 62 that abuts the belt and allow for an individual movement of the tool head 31 in relation to the belt when the gear rotates, as will be described in more detail further below. The aim of the tool head positioning device 10 is to move all the tool heads 30 from a first set of individual positions in the converting area 20, or starting positions, to a second set of individual positions or end positions in the converting area 20. In some cases, this will transport the tool heads 30 from a first converting station 21 in one part of the converting area 20 where they are able to act on one fanfold material to a second converting station 22 in another part of the converting area 20 where they are able to act on another fanfold material, as will be described in more detail further below. In other cases, the tool heads 30 will be transported within the same part of the converting area 20 and will be able to act on the same fanfold material but with at least one of the tool heads 31 being in a different position in the converting area 20 than before the movements.

The conveyor arrangement 41 may also comprise a rack, a chain, or a wire instead of the toothed belt in the preferred embodiment.

FIG. 2 shows a tool head 31 and an undercarriage 32 with a fanfold material 70 arranged between them. The tool head 31 comprises a cutter 33 and a creaser 34 and is therefore able to act on the fanfold material 70 with both a cutting and a creasing operation. During the conversion operation, the fanfold material 70 passes in the first direction from the right-hand side of FIG. 2 towards the left, but it may also be halted and passed back in the opposite direction before resuming its way in the first direction. FIG. 3 discloses in more detail the individual transport mechanism 60 having a motor 61 and a gear 62 operated by the motor 61 and acting on the conveyor arrangement 41.

The converting area 20 is defined herein as an area in which the tool heads 30 may act on the fanfold material 70 passing through the converting machine, and is in this preferred embodiment of a sufficient width for allowing at least two separate converting stations to be arranged side by side, each converting station holding one type of fanfold material. These different fanfold materials may have different properties and different dimensions, and are generally passed through the converting machine one at a time with the other remaining stationary but able to resume its movement in the first direction when desired. The operation of the converting machine is controlled by a control unit (not shown) that may be arranged to control the movement of the fanfold materials as well as the conversion operations performed by the tool heads 30 and the operation of the tool head positioning device 10. Alternatively, two or more control units may be provided that each control part of the operation of the converting machine and that may or may not communicate with each other, as desired.

The joint transport mechanism 40 comprises at least one motor 44 for operating the first and second conveyor wheels 42, 43 and thereby move the conveyor arrangement 41 so that any given point along the conveyor arrangement 41 is transported in a direction transversal to the first direction. When the tool heads 30 are coupled to the conveyor arrangement 41, this movement of the conveyor arrangement 41 creates the first movement that transports all the tool heads 30 along the width of the converting area 20 and thereby in the direction transversal to the first direction. Thus, the first movement is created by the conveyor arrangement 41 moving together with the tool heads 30.

As already mentioned above, the tool heads 30 are permanently coupled to the conveyor arrangement 41 in this preferred embodiment, and are attached by their individual transport mechanisms 60 each having a gear 62 that is held against the conveyor arrangement 41 and enable the second movement, where each tool head 31 moves in relation to the conveyor arrangement 41.

In another embodiment, one or more of the tool heads 30 may be permanently coupled to the conveyor arrangement 41 without the use of an individual transport mechanism 60, for instance by being firmly clamped onto the conveyor arrangement 41 or mounted in such a way that a second movement of that tool head 31 in relation to the conveyor arrangement 41 is not possible. In such an embodiment, the first movement is used to transport all tool heads 30 until the tool head 31 that is immovably mounted on the conveyor arrangement 41 has reached its intended end position, and the remaining tool heads 31 that have individual transport mechanisms 60 are simultaneously transported to their intended end positions by the second movements that are individually adapted to each tool head 31.

In some embodiments, the tool heads 30 may be released from the conveyor arrangement 41 during the times that they act on the fanfold material. They are then coupled to the conveyor arrangement 41 before the first movement takes place and are uncoupled after they have reached their end positions. The coupling to the conveyor arrangement 41 may be performed through an attachment mechanism comprising clamps or holders, or may be held by friction, magnetism or any other suitable holding force that enable the first movement to be performed with precision and subsequently release the tool heads 30.

The operation of the tool head positioning device 10 will now be described in more detail with reference to FIGS. 4-5, where FIG. 4 discloses tool heads 31 located at a first set of individual positions in a first converting station 21, and FIG. 5 discloses the same tool heads 31 located at a second set of individual positions in a second converting station 22.

Thus, FIG. 4 discloses six tool heads 31A, 31B, 31C, 31D, 31E, 31F with corresponding undercarriages 32A, 32B, 32C, 32D, 32E, 32F, each located at a starting position within a first converting station 21 and coupled or able to be coupled to the conveyor arrangement 41 of the joint transport mechanism 40. For the sake of simplicity six tool heads are shown, but as is readily understood by the person skilled in the art any number of tool heads can be used without deviating from the scope of the present invention.

For the sake of clarity, one point P on the conveyor arrangement 41 is also shown in order to illustrate the movement of the conveyor arrangement 41 itself. In this embodiment, each tool head 31 is coupled to an undercarriage, but of course any other suitable counter surface may alternatively be used, such as for instance a roll or a cylinder.

When the tool heads are to be transported from the first converting station 21 to the second converting station 22, a suitable combination of first movement for all tool heads 31 together and second movements for each or some of the tool heads 31 are determined, preferably by the control unit. Then, the first movement is performed and the conveyor arrangement moved to the right in FIG. 4 so that each tool head 31A, 31B, 31C, 31D, 31E, 31F is transported along with the conveyor arrangement. This can be illustrated by the point P being moved from its location in the first converting station 21 to a position in the second converting station 22 disclosed by FIG. 5.

During the first movement, at least one of the tool heads 31A, 31B, 31C, 31D, 31E, 31F but preferably a plurality of all of the tool heads 31A-31F perform an individual second movement through which said tool head or tool heads 31A-31F move in relation to the conveyor arrangement 41. This may also be illustrated through a second movement in relation to the point P disclosed by FIGS. 4-5. As can readily be seen by comparing FIG. 4 and FIG. 5, the tool head 31B to the left and the tool head 31D in the middle have been moved closer together by their second movements, whereas the tool head 31D in the middle and the tool head 31F to the right have been moved further apart.

Thanks to the first movement and the individual second movements taking place simultaneously, the entire tool head positioning from the starting positions disclosed by FIG. 4 to the end positions disclosed by FIG. 5 can be performed in a quicker and more reliable way than in the known prior art arrangements and methods. The motor 44 of the joint transport mechanism 40 is larger than the motors 61 of the individual positioning mechanisms 60, and a combination of a stronger motor for the larger movement from the first converting station 21 to the second converting station 22 can advantageously be combined with smaller and more precise movements of the smaller motors of the individual positioning mechanisms 60. Of course, the first set of positions and the second set of positions may be located within the same converting station 21, 22 but it is still advantageous to combine the first movement with the second movements in order to achieve a quick and robust but still highly precise movement of each tool head 31.

FIG. 4 and FIG. 5 show exemplary dimensions of the preferred embodiment described herein, given in mm. This is provided solely as an example and to facilitate understanding of the operation of the present invention, and is not to be seen as limiting the invention as is readily understood by the person skilled in the art. Thus, the width of the converting area is in this embodiment 2300 mm and the individual positions of the tool heads 31A-31F may be designated by their distance from any given reference point. Such a point may be given by the point P on the conveyor arrangement 41 or by the individual position of one of the tool heads 31, or may optionally also be given as the distance from one end of the converting area 20. In the example given in FIG. 4, disclosing a first set of individual positions for the tool heads 31A-F, the distance from each of the tool heads to the next is 100 mm, 500 mm, 50 mm, 100 mm and 100 mm, respectively. All the tool heads 31A-31F are located in the first converting station 21.

FIG. 5 discloses the second set of individual positions where all the tool heads 31A-31F have been moved to the second converting station 22. The distance from each tool head 31A-31F may also have been altered, giving their individual intervals as 100 mm, 100 mm, 50 mm, 500 mm, and 100 mm, respectively.

In one embodiment, the desired movement of the tools heads 31 is determined as follows:

Depending on a configuration of a next packaging template, a starting position for each tool head 31 for producing said packaging template is given. These starting positions are designated as the second set of individual positions for the tool heads 31. The control unit uses the second set of individual positions together with a first set of individual positions given by the current position of each tool head 31 and determines a suitable combination of the first movement of the conveyor arrangement 41 and individual movements for each of the tool heads 31 in order to move from the first to the second individual positions according to desired criteria. Such criteria can be to perform the movement as quickly as possible through a combination of a large first movement and smaller second movements, or alternatively to perform the movement through as small total movement as possible of all the tool heads 30 taken together. Other criteria may of course also be applied.

After the first and second movements have been decided, instructions are transmitted to each of the individual transport mechanisms 60 and to the joint transport mechanism 40 that then act to perform the second movements and the first movement, respectively.

Preferably, a point P on the conveyor arrangement 41 is used as a reference when determining the second movements of each tool head 31. The point P can be a center point in the converting station 21, 22 or can be and end point at one end of the converting station 21, 22. It may also be an arbitrarily selected point somewhere along the conveyor arrangement 41.

Preferably, the movements of the tool heads 30 are determined by first providing a first set of individual positions and a second set of individual positions. Then, a first movement of the transport mechanism and a second movement of each of the tool heads are determined, said first movement and second movement being selected for together transporting the tool heads from the first set of individual positions to the second set of individual positions. The first movement is then preferably selected so that the second movement of each tool head is minimized, i.e. so that the larger motor powering the conveyor arrangement 41 performs as much of the actual movement as possible. This is time efficient as well as power efficient.

The method according to the present invention may be carried out in a data processing apparatus that comprises means suitable therefore, for instance a computer, microcomputer or similar. Instructions resulting in the steps of the method disclosed herein may also be stored in the form of a computer program product on a computer-readable medium, such as a hard drive, memory device, disc or USB. The control unit mentioned above may comprise preprogrammed data relating to the desired movements from the first set of individual positions to the second set of individual positions, but may also be able to receive dynamic input from a user through a suitable input such as a touchscreen, keyboard or similar, and may also provide output to the user through any suitable output.

Furthermore, it is to be noted that all embodiments of the present invention described herein may freely be combined with each other, unless it is explicitly stated that such a combination would be unsuitable.

What is claimed is:

1. A tool head positioning device for a converting machine for converting sheet material into box templates, comprising:

a plurality of tool heads arranged in a converting area and able to act on sheet material being transported through said converting area, a joint transport mechanism having a conveyor arrangement that is arranged to be coupled to each of the tool heads and to perform a simultaneous first movement of the plurality of tool heads within the converting area by the conveyor arrangement moving together with the tool heads, and a plurality of individual transport mechanisms, each arranged at a tool head and able to actively perform a second movement of that tool head relative to both the conveyor arrangement of the joint transport mechanism and the other tool heads, wherein the joint transport mechanism and the plurality of individual transport mechanisms are arranged to move the plurality of tool heads from a first set of individual positions to a second set of individual positions, and wherein the second movement takes place during the first movement.

2. The tool head positioning device according to claim 1, wherein the conveyor arrangement comprises a toothed belt.

3. The tool head positioning device according to claim 1, wherein the conveyor arrangement comprises a rack, a belt, a chain or a wire.

4. The tool head positioning device according to claim 1, wherein the conveyor arrangement is permanently coupled to each of the tool heads.

5. The tool head positioning device according to claim 1, further comprising an attachment mechanism for attaching one or more of the tool heads to the conveyor arrangement, said attachment mechanism comprising one or more clamps for clamping the one or more tool heads to the conveyor arrangement.

6. The tool head positioning device according to claim 1, wherein the individual transport mechanisms each comprise a motor connected to the tool head, wherein said motor acts on the conveyor arrangement to move the tool head along the conveyor arrangement.

7. The tool head positioning device according to claim 1, wherein one or more of the tool heads is connected with an individual transport mechanism for moving the tool heads along the conveyor arrangement.

8. The tool head positioning device according to claim 1, wherein the converting area comprises at least two converting stations arranged side-by-side, and wherein the first set of individual positions is located at one of the converting stations and the second set of individual positions is located at another.

9. A method for positioning a plurality of tool heads in a converting machine for converting sheet material into box templates, comprising:

providing a plurality of tool heads located at a first set of individual positions within a converting area, simultaneously moving the plurality of tool heads within the converting area in a first movement by means of a joint transport mechanism that is arranged to be coupled individually to each tool head, moving at least one of the plurality of tool heads relative to the transport mechanism and the other tool heads in a second movement, wherein the plurality of tool heads are moved to a second set of individual positions by the first and second movement, and wherein the second movement takes place during the first movement.

10. A method for positioning a plurality of tool heads according to claim 9, wherein the first movement is performed by a conveyor arrangement of the joint transport mechanism being coupled to each tool head and acting as a carrier for bringing the tool heads along.

11. A method for positioning a plurality of tool heads according to claim 10, wherein the conveyor arrangement is permanently coupled to the tool heads.

12. A method for positioning a plurality of tool heads according to claim 10, wherein the conveyor arrangement is coupled to the tool heads before the first movement and uncoupled afterwards.

13. A method according to claim 10, further comprising using the first and second sets of individual positions to determine a desired first movement of the conveyor arrangement and corresponding desired second movements of the tool heads in relation to the conveyor arrangement, and to perform said desired first and second movements to arrive at the second set of individual positions for the tool heads.

14. A method for positioning a plurality of tool heads according to claim 9, wherein the converting area comprises at least two converting stations arranged side-by-side, and wherein the first and second movements move the tool heads from the first set of individual positions in one of the converting stations to the second set of individual positions in another.

15. A method according to claim 9, further comprising:

determining the first movement of the transport mechanism and the second movement of each of the tool heads, said first movement and second movement being selected for together transporting the tool heads from the first set of individual positions to the second set of individual positions, wherein the first movement is selected so that the second movement of each of the tool heads is minimized.

16. A data processing apparatus comprising means for carrying out the method of claim 9.

17. A computer program product comprising instructions which, when the program is executed by a computer, cause the computer to carry out the method of claim 9.

18. A computer-readable medium comprising instructions which, when executed by a computer, causes the computer to carry out the method of any of claim 9.

19. A tool head positioning device for a converting machine for converting sheet material into box templates, comprising:

a plurality of tool heads arranged in a converting area and able to act on sheet material being transported through said converting area, a joint transport mechanism having a conveyor arrangement that is arranged to be coupled to each of the tool heads and to perform a first movement of the plurality of tool heads within the converting area by the conveyor arrangement moving together with the tool heads, and a plurality of individual transport mechanisms, each arranged at a tool head and able to perform a second movement of that tool head relative to the conveyor arrangement, wherein the individual transport mechanisms each comprise a motor connected to the tool head, wherein said motor acts on the conveyor arrangement to move the tool head along the conveyor arrangement, wherein the joint transport mechanism and the plurality of individual transport mechanisms are arranged to move the plurality of tool heads from a first set of individual positions to a second set of individual positions.

20. The tool head positioning device according to claim 19, wherein the plurality of individual transport mechanisms are configured to move the tool heads in the second movement during the first movement.

* * * * *